US010024123B2

(12) United States Patent
Steffenhagen et al.

(10) Patent No.: US 10,024,123 B2
(45) Date of Patent: Jul. 17, 2018

(54) COILED TUBING INJECTOR WITH HYDRAULIC TRACTION SLIP MITIGATION CIRCUIT AND METHOD OF USE

(71) Applicant: National Oilwell Varco, L.P., Houston, TX (US)

(72) Inventors: Timothy S. Steffenhagen, Fort Worth, TX (US); William B. White, Bedford, TX (US)

(73) Assignee: National Oilwell Varco, L.P., Houston, TX (US)

( * ) Notice: Subject to any disclaimer, the term of this patent is extended or adjusted under 35 U.S.C. 154(b) by 139 days.

(21) Appl. No.: 14/908,272

(22) PCT Filed: Aug. 1, 2014

(86) PCT No.: PCT/US2014/049493

§ 371 (c)(1),
(2) Date: Jan. 28, 2016

(87) PCT Pub. No.: WO2015/017835

PCT Pub. Date: Feb. 5, 2015

(65) Prior Publication Data

US 2016/0186509 A1 Jun. 30, 2016

Related U.S. Application Data

(60) Provisional application No. 61/861,352, filed on Aug. 1, 2013.

(51) Int. Cl.
*E21B 19/22* (2006.01)
*E21B 44/02* (2006.01)

(52) U.S. Cl.
CPC ..... *E21B 19/22* (2013.01); *E21B 44/02* (2013.01)

(58) Field of Classification Search
CPC ..... E21B 19/22; E21B 44/02; B65G 23/14
(Continued)

(56) References Cited

U.S. PATENT DOCUMENTS 3,132,622 A * 5/1964 Hackenberger ..... F15B 11/17 114/244
3,841,407 A * 10/1974 Bozeman ..... E21B 19/22 166/384

(Continued)

OTHER PUBLICATIONS

Reel Direction, A Publication of National Oilwell Varco, Spring 2009, (p. 1-8).

*Primary Examiner* — Giovanna C. Wright
*Assistant Examiner* — Jonathan Malikasim
(74) *Attorney, Agent, or Firm* — Jonathan M. Pierce; Porter Hedges LLP

(57) ABSTRACT

When one of at least two independently driven gripper chains (102) of a coiled tubing injector (100) begins to turn faster than another one of the injector's other independently drive gripper chains by an amount that indicates slipping of one of the independently driven gripper chains relative to tubing (109) being held between the driven gripper chains, a hydraulic timing circuit (318), which is coupled with the driven chains through hydraulic timing motors (214, 216), generates a pressure signal that causes the injector's hydraulic traction system to increase the hydraulic pressure applied by hydraulic cylinders (220) to generate a normal force applied by grippers on the chains to the tubing.

22 Claims, 4 Drawing Sheets

(58) Field of Classification Search
USPC ..... 166/77.2, 77.3
See application file for complete search history.

(56) References Cited

U.S. PATENT DOCUMENTS

| | | | | |
|---|---|---|---|---|
| 5,158,781 | A | 10/1992 | Gatto | |
| 5,325,668 | A * | 7/1994 | Walchhutter | B30B 15/26 264/40.5 |
| 5,775,417 | A | 7/1998 | Council | |
| 5,850,874 | A | 12/1998 | Burge et al. | |
| 6,968,905 | B2 * | 11/2005 | Adnan | G05B 15/02 166/113 |
| 8,651,190 | B2 * | 2/2014 | Dietz | E21B 33/064 166/250.01 |
| 2005/0247455 | A1 | 11/2005 | Domann | |
| 2012/0073833 | A1 | 3/2012 | McCulloch et al. | |

* cited by examiner

COILED TUBING INJECTOR WITH HYDRAULIC TRACTION SLIP MITIGATION CIRCUIT AND METHOD OF USE

BACKGROUND

"Coiled tubing injectors" are machines for running pipe into and out of well bores. Typically, the pipe is continuous, but injectors can also be used to raise and lower jointed pipe. Continuous pipe is generally referred to as coiled tubing since it is coiled onto a large reel when it is not in a well bore. The terms "tubing" and "pipe" are, when not modified by "continuous," "coiled" or "jointed," synonymous and encompass both continuous pipe, or coiled tubing, and jointed pipe. "Coiled tubing injector" and, shortened, "injector" refer to machines used for running any of these types of pipes or tubing. The name of the machine derives from the fact that it is typically used for coiled tubing and that, in preexisting well bores, the pipe must be literally forced or "injected" into the well through a sliding seal to overcome the pressure of fluid within the well, until the weight of the pipe in the well exceeds the force produced by the pressure acting against the cross-sectional area of the pipe. However, once the weight of the pipe in the well overcomes the pressure, it must be supported by the injector. The process is reversed as the pipe is removed from the well.

Coiled tubing is faster to run into and out of a well bore than conventional jointed or straight pipe and has traditionally been used primarily for circulating fluids into the well and other work over operations, but can be used for drilling. For drilling, a turbine motor is suspended at the end of the tubing and is driven by mud or drilling fluid pumped down the tubing. Coiled tubing has also been used as permanent tubing in production wells. These new uses of coiled tubing have been made possible by larger diameters and stronger pipe.

Examples of coiled tubing injectors include those shown and described in U.S. Pat. Nos. 5,309,990, 6,059,029, and 6,173,769, all of which are incorporated herein by reference.

A conventional coiled tubing injector has two continuous chains, though more than two can be used. The chains are mounted on sprockets to form elongated loops that counter rotate. A drive system applies torque to the sprockets to cause them to rotate, resulting in rotation of the chains. In most injectors, chains are arranged in opposing pairs, with the pipe being held between the chains. Grippers carried by each chain come together on opposite sides of the tubing and are pressed against the tubing. The injector thereby continuously grips a length of the tubing as it is being moved in and out of the well bore. The "grip zone" or "gripping zone" refers to the zone in which grippers come into contact with a length of tubing passing through the injector.

Several different arrangements can be used to push the grippers against the tubing. One common arrangement uses a skate to apply an even force to the back of the grippers as they pass through the grip zone. In one example, each gripper has a cylindrical roller, or multiple rollers with the same axis of rotation, mounted to its back. The rollers roll along a continuous, planar surface formed by the skate as the grippers pass through the gripping zone. By properly positioning the skate with respect to the tubing, the skate can push the grippers against the tubing with force or pressure that is normal to the tubing. In an alternative arrangement rollers are mounted on the skate, and the back of the grippers have a flat or planar surface that ride along the rollers. The axes of the rollers are co-planar, so that the rollers engage the back of the skates in the same plane, thus effectively presenting a planar rolling surface on which the grippers may roll.

A coiled tubing injector applies a normal force to its grippers. The normal force creates through friction an axial force along the longitudinal axis of the tubing. The amount of traction between the grippers and the tubing is determined, at least in part, by the amount of this force. In order to control the amount of the normal force, skates for opposing chains are typically pulled toward each other by a traction system comprising hydraulic pistons or a similar mechanism, thereby forcing the gripper elements against the tubing. Alternatively, skates are pushed toward each other. The force applied by the traction system to the chains, and thus to the tubing against which the chains are pressed, is adjustable to take into account different operating conditions.

If the force at which a traction system for a coiled tubing injector is set is insufficient for any reason, the injector will lose grip on the tubing. When independently driven chains are used in coiled tubing injectors, there is also a risk that one or more of the chains will begin to slip on the tubing before the other. Once a chain begins to slip on the tubing, the type of friction changes from static to dynamic and the traction of the slipping chain is greatly diminished. When grip is lost, damage to the coiled tubing is possible. Damage is more likely the further the tubing is allowed to slip in the injector chains. When the tubing speed increases, it is more difficult to regain grip and the potential of damage to the tubing, machinery, and the well increases.

SUMMARY

When one of at least two independently driven gripper chains of a coiled tubing injector begins to turn faster than another one of the injector's other independently drive gripper chains by an amount that indicates slipping of one of the independently driven gripper chains relative to tubing being held between the driven gripper chains, a hydraulic timing circuit, which is coupled with the driven chains, generates a pressure signal that causes the injector's hydraulic traction system to increase the normal force applied by grippers on the chains to the tubing.

Such a coiled tubing injector is capable of detecting chain slippage and increasing traction pressure in response to it without intervention of an operator. It can be used to particular advantage in situations in which the injector is located remotely from an operator, such as on top of a riser high above well, where an operator cannot easily see slippage starting or react to it quickly.

In one exemplary embodiment the hydraulic timing circuit is comprised of a hydraulic timing motor coupled to each one of a coiled tubing injector's two or more chains. The hydraulic timing motors are connected in a hydraulic circuit so that pressure is generated within the circuit when the speed at which one of independently driving gripper chains turns one of the timing motors is at least a predetermined amount faster than the speed that another one of the independently driven chains turns the other timing motor. The pressure within the timing circuit, when it reaches or exceeds a predetermined amount, is used as a signal to cause a traction system on the coiled tubing injector to increase traction force applied by the chain to the tubing. For example, the pressure within the timing circuit can be used to shift or open a valve to increase hydraulic pressure supplied to the traction control system by, for example, connecting in a supply of hydraulic fluid under greater pressure.

DETAILED DESCRIPTION OF EXEMPLARY EMBODIMENTS

In the following description, like numbers refer to like elements.

Figure 1:
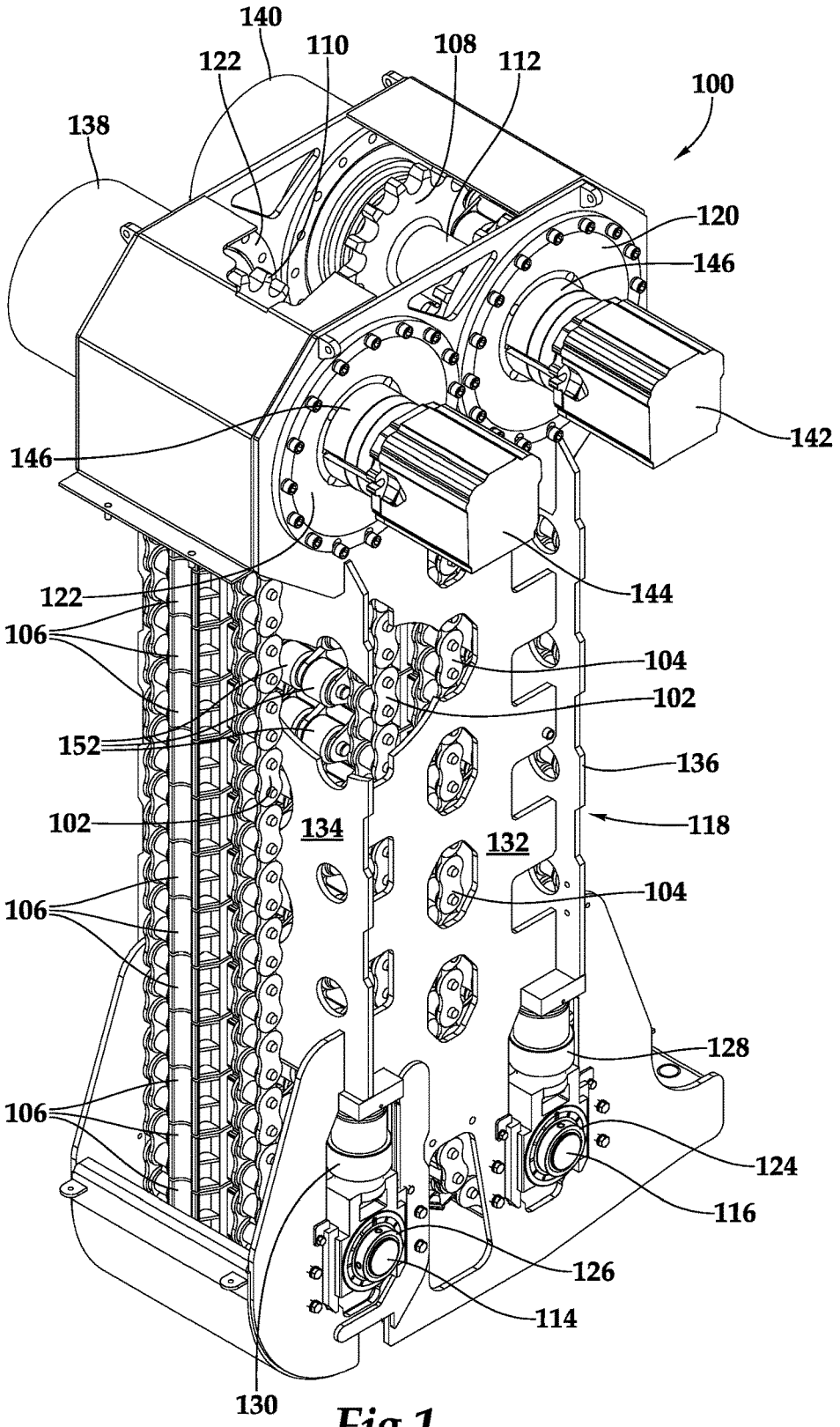
FIG. 1 is a perspective view of a representative coiled tubing injector.
Figure 2:
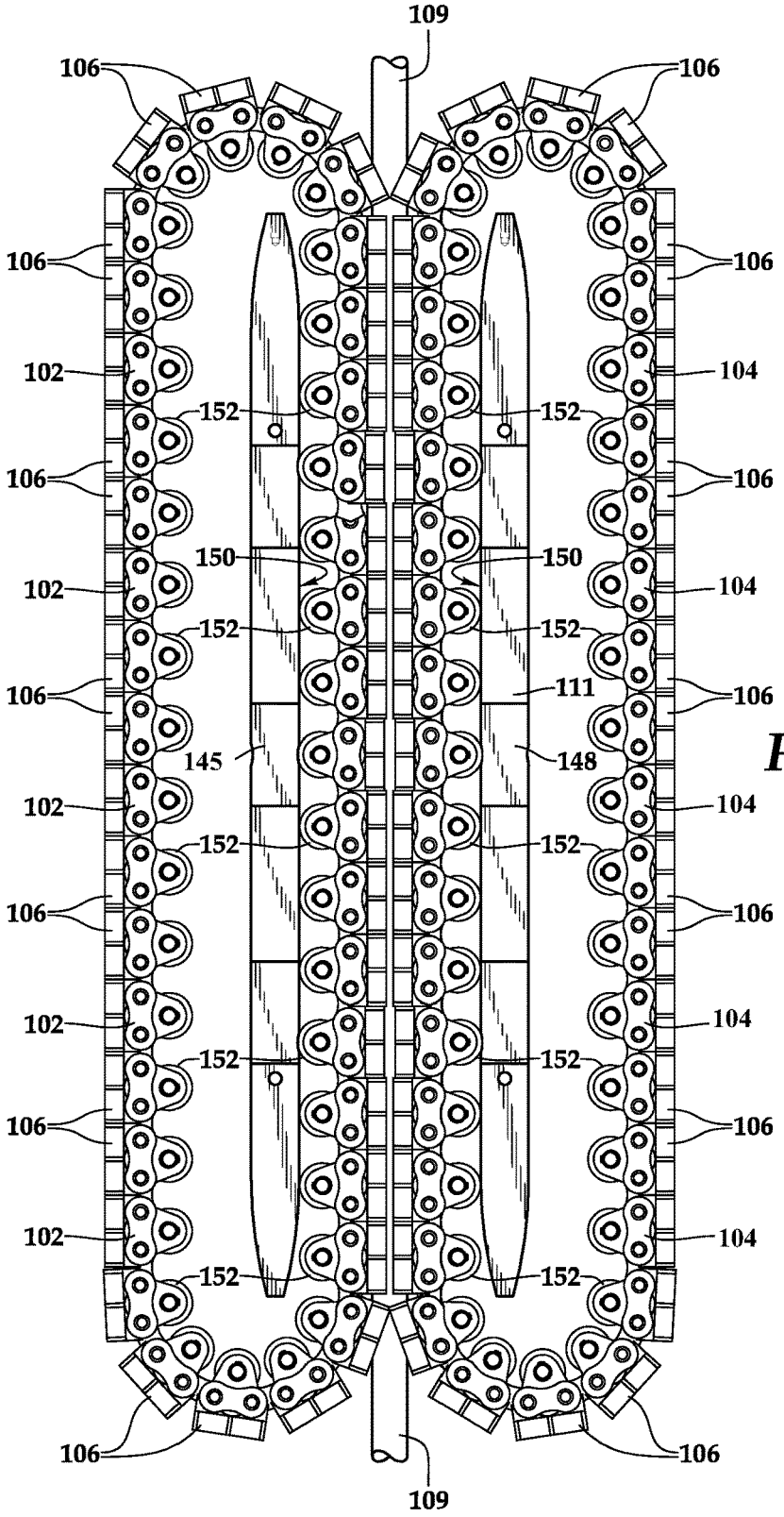
FIG. 2 is a perspective view of a representative coiled tubing injector.

Referring to FIGS. 1 and 2, injector 100 is intended to be representative, non-limiting example of a coiled tubing injector for running coiled tubing and pipe into and out of well bores. It has two, counter rotating drive chains 102 and 104. Each of the chains carries a plurality of gripping elements or grippers 106. The chains are thus sometimes also referred to as gripper chains. Each of the grippers on a chain is shaped to conform to, or complement, the outer diameter or outer surface curvature of tubing 109 (not shown in FIG. 1) that will be gripped. The grippers on the respective chains come together in an area referred to as a gripping zone. As the tubing 109 passes through the injector it enters the gripping zone. On the gripping zone, the grippers from each of the chains cooperate to grip the tubing and substantially encircle the tubing to prevent it from being deformed. In this example, the gripping zone is substantially straight, with the sections of the respective chains within the gripping zone extending straight and parallel to each other. The center axis of the tubing is coincident with a central axis of the gripping zone. In the illustrated example, which has only two chains, chains 102 and 104 revolve generally within a common plane. (Please note that, in FIG. 1, chains 102 and 104 are cut away at the top of the injector in order to reveal the sprockets on which they are mounted.) Injectors may comprise more than two drive chains. For example, a second pair of drive chains can be arranged in an opposing fashion within a plane that is ninety degrees to the other plane, so that four gripping elements come together to engage the tubing as it passes through the injector.

Referring now only to FIG. 1, each drive chain of an injector is mounted or supported on at least two sprockets, one at the top and the other at the bottom of the injector. The upper and lower sprockets are, in practice, typically comprised of two spaced-apart sprockets that rotate around a common axis. In the representative example of FIG. 1, only one of each pair of sprockets 108 and 110 is visible. The upper sprockets in this example of an injector are driven. The drive sprockets are connected to a drive axle or shaft that is rotated by a drive system. Only one shaft, referenced by number 112, for upper drive sprocket pair 108, is visible in FIG. 1. The lower sprockets, which are not visible in the figures, except for the end of shafts 114 and 116 to which they are connected, are not driven in this representative injector. They are referred to as idler sprockets. The lower sprockets could, however, be driven, either in place of or in addition to, the upper sprockets. Furthermore, additional sprockets could be added to the injector for the purpose of driving each of the chains.

The sprockets are supported by a frame generally indicated by the reference number 118. The shafts for the upper sprockets are held on opposite ends by bearings. These bearings are located within two bearing housings 120 for shaft 112 and two bearing housings 122 for the other shaft that is not visible. The shafts for the lower sprockets are also held on opposite ends by bearings, which are mounted within moveable carriers that slide within slots with the frame. Only two front side bearings 124 and 126 can be seen in the figures. Allowing the shafts of the lower sprockets to move up and down permits the chains to be placed under constant tension by hydraulic cylinders 128 and 130.

The frame 118, in this particular example of an injector, takes the form of a box, which is formed from two, parallel plates, of which plate 132 is visible in the drawing, and two parallel side plates 134 and 136. The frame supports sprockets, chains, skates and other elements of the injector, including a drive system and brakes 146. Each brake is coupled to a separate one of the drive shafts, on which the upper sprockets are mounted. In a hydraulically powered system, the brakes are typically automatically activated in the event of a loss of hydraulic pressure.

A drive system for the injector is comprised of at least one motor, typically hydraulically driven, but electric motors are also used. Injector 100 has two motors 142 and 144, one for each of the gripper chains. More motors could be added for driving each chain, for example by connecting them to the same shaft, or by connecting them to a separate sprocket on which the chain is mounted. The output of each motor is coupled to the shaft of the drive sprocket for the chain being driven by the motor, the motor thereby also being coupled with the chain. Each motor is coupled either directly or indirectly, such as through an arrangement of gears, an example of which is a planetary gear box 140 (for coupling motor 142) or 138 (for coupling motor 144). However, only one motor can be used. It can drive either just one chain (with the other not being driven) or both chains by coupling it, directly or indirectly, through gearing a drive sprocket for each chain.

Examples of such gearing include a differential gear drive with multiple outputs or by gears coupling the two drive sockets. If a hydraulic motor is used, it is supplied, when the injector is put into operation, with pressurized hydraulic fluid received over hydraulic lines connected with a power pack, the power pack comprising a hydraulic pump powered by, for example, a diesel engine. The same power pack can be used to operate other hydraulic circuits, including hydraulic cylinders for generating a traction force, as described below.

Referring to FIG. 1 and FIG. 2, coiled tubing injector 100 includes for each chain 102 and 104 a skate 145 and 148, respectively, for pressing gripping elements 106 within the gripping zone against tubing 109. Note that the skates are visible only FIG. 2. The skates apply a normal force to the gripping elements, which transfer that force to the tubing to generate frictional force (referred to as the gripping force) for holding the tubing as it passes through the gripping zone. The greater the normal force, the greater the traction force. The normal force is generated in part by a plurality of hydraulic cylinders. Each of the hydraulic cylinders is connected at a discrete position along the length of the gripping zone. They generate equal forces to pull together the skates at multiple points along their lengths, thereby applying uniform gripping pressure against the tubing 109 along the length of the skates. In alternative embodiments, one or more hydraulic cylinders can be arranged to push or pull the skates toward each other.

Figure 3:
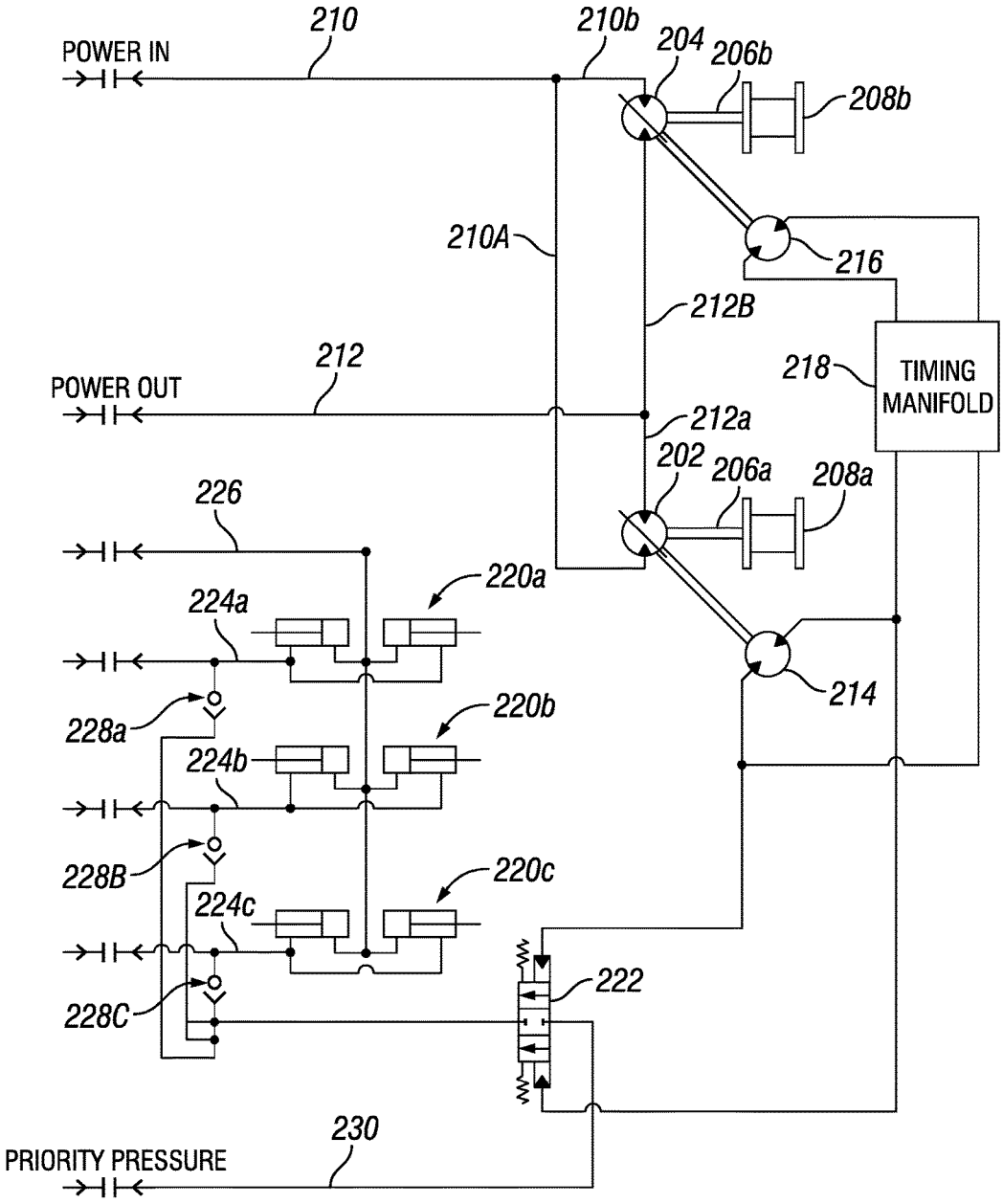
FIG. 3 is a schematic diagram of a first embodiment of hydraulic circuit for automatically controlling traction pressure of a coiled tubing injector in response to detecting chain slippage.
Figure 4:
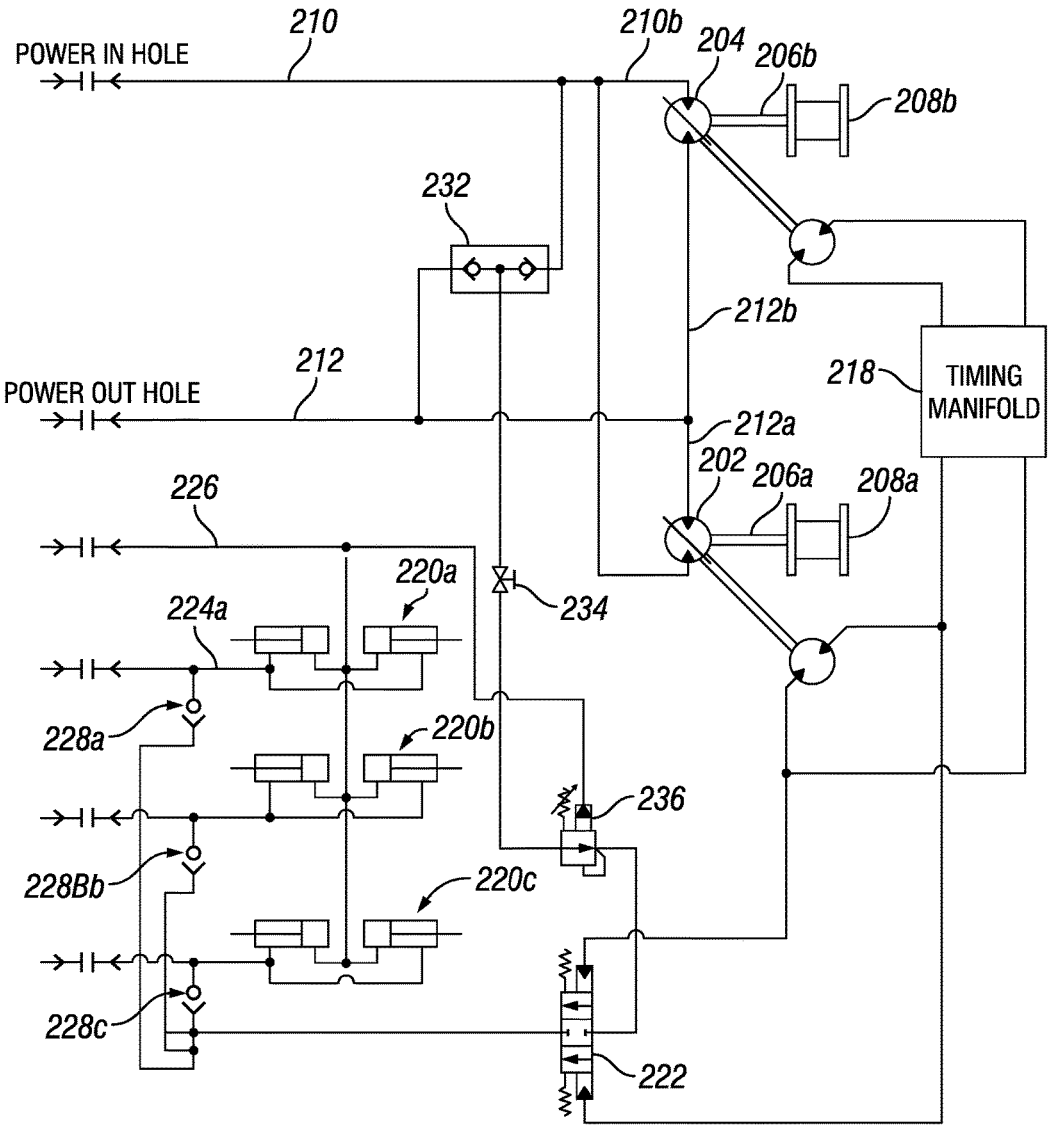
FIG. 4 is a schematic diagram of a second embodiment of hydraulic circuit for automatically controlling traction pressure of a coiled tubing injector in response to detecting chain slippage.

FIGS. 3 and 4 are schematic diagrams of examples of representative embodiments of hydraulic circuits for use with the injectors such as the one shown in FIG. 1. In these schematics, drive motors 142 and 144 of FIG. 1 correspond to hydraulic motors 202 and 204 in FIGS. 3 and 4. However, in alternate embodiments, the drive motors can be electric motors. Each drive motor has an output shaft 206*a* and 206*b*, respectively, coupled to a respective drive sprocket 208*a* and 208*b*. The drive motor may, optionally, be coupled through a gear box, such as a planetary gear box, and/or a brake. Each drive sprocket drives rotation of a different gripper chain (not shown). Thus, in this example, the circuit is driving two gripper chains.

Pressurized hydraulic fluid from, for example, a power pack (not shown) is supplied through supply line 210 (labeled "Power In") to hydraulic drive motor 202, through branch 210*a*, and drive motor 204, through branch 210*b*. The hydraulic motors are connected to the return line 212 (labeled "Power Out") through lines 212*a* and 212*b*, respectively. The drive motors are, thus, connected to the hydraulic power supply in parallel.

Each of the timing motors 214 and 216 is coupled, respectively, to one of the two drive chains (not shown) so that it rotates at a speed that is in a fixed relationship to the rotational speed of the chain. In this example, each timing motor is connected, respectively, to the drive shafts of the respective one of the drive motors 202 and 204, as is shown in FIG. 1. However, a timing motor could be indirectly connected or coupled, such as through gearing, to the drive motor or sprocket on which the chain is mounted. Each of the timing motors, in this example, is comprised of a positive displacement hydraulic motor.

In this example, the hydraulic timing motors 214 and 216 are connected in series in a closed circuit through a timing manifold 218. Each timing motor acts only to transfer force from one drive motor to the other when one is turning faster than the other. The timing manifold allows speed differences less than a predetermined amount between the motors to exist without building pressure within the circuit. Small differences between rotation speeds could be due to, for example, one gripping chain being slightly longer than the other. Such differences are insubstantial and do not indicate that, for example, one of the driven gripper chains is slipping on the tubing. In fact such differences may be desirable, as they accommodate, for example, slight difference in chain lengths and thus avoid tension that would otherwise have be relieved through slippage of one of the driven chains. The timing manifold allows a small, predetermined amount of hydraulic fluid to bleed across the circuit, thereby reducing pressure that would otherwise exist. However, when the speed difference in the timing motors grows to an amount that indicates that one of the gripper chains could be slipping relative to the tubing, the timing manifold is designed so that it is not able to relieve the pressure, and thus pressure will exist within the timing circuit. Pressure within the closed timing circuit acts to slow the faster turning timing motor, and thus also the drive motor to which it is connected, and speeds up the slower turning timing motor and the drive motor to which it is attached. If insubstantial speed difference between the independently driven chains is to be allowed, it is preferred to reduce or relieve pressure from within the circuit at those speed differences. However, in the alternative, the hydraulic timing circuit can be constructed without a timing manifold, or the timing manifold can be made adjustable and set to so that it does not reduce pressure within the circuit even at insubstantial speed differences.

Conventional coiled tubing injectors grip tubing with a traction system that applies a normal force to the tubing. The amount of force can be adjusted by setting a hydraulic circuit supplying hydraulic pressure to the traction system. Should a setting be insufficient it will cause the injector to lose grip on the tubing. When grip is lost, damage to the coiled tubing is possible and will be more likely the further the tubing is allowed to slip in the injector chains. In extreme cases of slipping, the speed at which the tubing slips relative to the gripper chain increases, thus making it more difficult to regain grip and increasing the potential of damage to the tubing, machinery, and the well. As coiled tubing injectors are sometimes mounted on top of tall risers connected to a wellhead, operators located far away may not be able to detect slips and make the proper adjustments to correct slips in time to avoid the related tubing slip damages and dangers.

Pressure within the hydraulic timing circuit is, in the illustrated embodiment, also used to cause or to signal for an increase in the hydraulic pressure supplied to the coiled tubing injector's traction system, thus increasing the normal force applied the grippers on the chains. By slowing the slipping gripper chain and automatically and rapidly increasing gripping force on the tubing as the slipping begins to occur, the exemplary embodiments of FIGS. 3 and 4 will tend to mitigate slippage, and enable the gripper to regain grip of the tubing in the event of an injector's traction system slipping The circuits of FIGS. 3 and 4 represent examples for making use of the pressure within the timing circuit as a control signal for changing or adjusting the hydraulic pressure being supplied to the traction system of a coiled tubing injector by a hydraulic traction pressure circuit, and thus adjusting the normal force being applied by the grippers. The two examples differ primarily in the source of a priority hydraulic pressure used for increasing the force supplied by the traction control circuit to the traction system, and thus of the grippers to the tubing.

In both examples, a priority pressure circuit is connected in parallel to the timing motors 214 and 216, and the timing manifold 218. The priority pressure circuit is comprised, in these examples, of directional valve 222. A pressure differential in the timing circuit in excess of a predetermined level causes directional valve 222 to shift, thereby connecting a source of priority hydraulic pressure to a hydraulic traction control circuit that controls the traction system. In this representative example, the traction system comprises three hydraulic cylinders 220*a*, 220*b*, and 220*c* that apply pressure to tubing being gripped by the traction system of the coiled tubing injector, the traction system being comprised of skates 145 and 148 of the representative injector illustrated by FIGS. 1 and 2. The hydraulic traction pressure circuit is comprised of, in this example, the hydraulic cylinders and lines 224*a*, 224*b*, and 224*c*. The hydraulic traction pressure circuit supplies each hydraulic cylinder in parallel with hydraulic fluid at a predetermined set pressure. The pressure within the cylinders results in a normal force being applied to the tubing. In the example of FIGS. 1 and 2, the force causes skates 145 and 148 (FIG. 1) to move toward the tubing, resulting in a normal force being applied to the tubing by grippers on the gripper chaining moving along the skates. The drains of the cylinders are connected to a common drain line 226. The priority pressure circuit connects through check valves 228*a*, 228*b*, and 228*c*, respectively, to the traction control circuit to increase pressure to the priority pressure. The priority pressure is greater than the set pressure. The check valves prevent pressure from returning to the timing circuit and ensure that the traction circuits are isolated from each other. Traction pressure thus increases towards a maximum setting equal to the priority pressure while tubing is slipping, and otherwise remains at the set pressure.

In the example of FIG. 3, priority pressure is supplied through hydraulic line 230 by, for example, an injector-mounted hydraulic pressure supply. In the example of FIG. 4, priority pressure is instead supplied from the main hydraulic power supply for the drive motors, which is through the circuit comprised of hydraulic lines 210 and 212. Shuttle valve 232, which is optional, transfers the higher of the two pressures on lines 210 and 212 to the directional valve 222 through a hydraulic line connecting the two. The line may, optionally include a manually operated valve 234 for disconnecting or turning off the main pressure supply to the priority pressure circuit. Furthermore, the hydraulic fluid from the shuttle valve, may pass through a pressure reducing valve 236 to limit the supply pressure to the maximum traction force setting applied by the grippers. The pressure-reducing valve is connected, in this example, to drain line 226.

The foregoing description is of exemplary and preferred embodiments employing at least in part certain teachings of the invention. The invention, as defined by the appended claims, is not limited to the described embodiments. Alterations and modifications to the disclosed embodiments may be made without departing from the invention. The meaning of the terms used in this specification are, unless expressly stated otherwise, intended to have ordinary and customary meaning and are not intended to be limited to the details of the illustrated structures or the disclosed embodiments.

What is claimed is:

1. A coiled tubing injector, comprising:

at least two chains, each with a plurality of grippers for gripping coiled tubing within a gripping zone between the at least two chains;

a traction system for generating a gripping force applied to the at least two chains, a hydraulic traction pressure circuit comprised in the traction system;

a supply of hydraulic fluid at a set pressure;

a supply of hydraulic fluid at a priority pressure, wherein the priority pressure is greater than the set pressure;

a hydraulic timing circuit coupled with the at least two chains, the hydraulic timing circuit generating a hydraulic pressure signal indicating that a difference in speeds of the at least two chains is greater than a predetermined amount, wherein a pressure differential within the hydraulic timing circuit is used as the hydraulic pressure signal, wherein the traction system increases the gripping force in response to the hydraulic pressure signal; and a valve, wherein the hydraulic pressure signal actuates the valve to increase pressure of hydraulic fluid supplied to the hydraulic traction pressure circuit, wherein the valve selectively connects the supply of hydraulic fluid at the priority pressure to the hydraulic traction pressure circuit.

2. The coiled tubing injector of claim 1, wherein each of the at least two chains is independently driven.

3. The coiled tubing injector of claim 1, wherein the hydraulic timing circuit comprises at least two timing motors, each coupled to a separate one of the at least two chains, the timing motors being connected within the hydraulic timing circuit in a manner to generate pressure within the hydraulic timing circuit when the speed at which one of the at least two chains turns one of the timing motors is at least a predetermined amount faster than the speed that another one of the at least two chains turns the other timing motor.

4. The coiled tubing injector of claim 3, wherein the at least two timing motors are connected in series in a closed circuit through a timing manifold that permits speed differences between the at least two timing motors less than the predetermined amount to exist without building pressure within the hydraulic timing circuit by allowing a small, predetermined amount of hydraulic fluid to bleed across the closed circuit, thereby reducing pressure that would otherwise exist.

5. The coiled tubing injector of claim 1, wherein the supply of hydraulic fluid at the priority pressure is from an injector-mounted hydraulic pressure supply.

6. The coiled tubing injector of claim 1, wherein the supply of hydraulic fluid at the priority pressure is from a main hydraulic power supply for one or more hydraulic drive motors coupled with the at least two chains.

7. The coiled tubing injector of claim 1, wherein the traction system further comprises:

a plurality of skates, at least one skate for each of the at least two chains, for pressing grippers within the gripping zone toward the coiled tubing; and a plurality of hydraulic cylinders coupled to the plurality of skates at discrete positions along the length of the gripping zone for applying the gripping force.

8. A coiled tubing injector, comprising:

at least two chains, each with a plurality of grippers for gripping coiled tubing within a gripping zone between the at least two chains;

a hydraulic timing circuit coupled with the at least two chains, the hydraulic timing circuit generating a hydraulic pressure signal indicating that a difference in speeds of the at least two chains is greater than a predetermined amount; and a traction system for generating a gripping force applied to the at least two chains, wherein the traction system increases the gripping force in response to the hydraulic pressure signal, wherein the traction system comprises a valve for shifting between supplies of hydraulic fluid under different pressures.

9. The coiled tubing injector of claim 8, further comprising:

a main hydraulic power supply for one or more hydraulic drive motors coupled with the at least two chains, wherein the main hydraulic power supply comprises a power-in line having hydraulic fluid at a first pressure and a power-out line having hydraulic fluid at a second pressure, wherein one of the supplies of hydraulic fluid under different pressures comprises a shuttle valve arranged between the power-in line and the power-out line, and wherein the shuttle valve is configured to direct the hydraulic fluid at the higher of the first and second pressures to the valve.

10. The coiled tubing injector of claim 9, wherein the hydraulic fluid directed by the shuttle valve passes through a pressure reducing valve before reaching the valve.

11. A coiled tubing injector, comprising:

a plurality of skates to press, within a gripping zone, first and second chains toward a coiled tubing;

at least one hydraulic cylinder coupled to one of the plurality of skates to apply a force to the one of the plurality of skates;

first and second timing motors, coupled to the first and second chains, respectively;

a closed circuit hydraulically connecting the first and second timing motors in series to transfer force between the first and second chains;

a first supply of hydraulic fluid at a first pressure level, the first supply being connected to the at least one hydraulic cylinder;

a second supply of hydraulic fluid at a second pressure level; and a valve actuated by a pressure differential within the closed circuit, wherein the valve selectively connects the second supply of hydraulic fluid to the at least one hydraulic cylinder.

12. The coiled tubing injector of claim 11, wherein the second pressure level is greater than the first pressure level, and wherein a magnitude of the pressure differential in excess of a predetermined level causes the valve to connect the second supply of hydraulic fluid to the at least one hydraulic cylinder.

13. The coiled tubing injector of claim 11, wherein the valve is piloted in parallel with at least one of the first and second timing motors.

14. The coiled tubing injector of claim 11, wherein the closed hydraulic circuit comprises a manifold coupled across at least one of the first and second timing motors, to bleed hydraulic fluid.

15. The coiled tubing injector of claim 11, wherein the second supply of hydraulic fluid comprises:

a main hydraulic supply coupled to a drive motor to rotate at least one of the first and second chains; and a pressure reducing valve coupled to the main hydraulic supply.

16. The coiled tubing injector of claim 11 further comprising first and second drive motors coupled to the first and second chains, respectively, wherein a main hydraulic supply is connected in parallel to the first and second drive motors to rotate the first and second chains independently.

17. A method of using a coiled tubing injector, comprising:

rotating first and second timing motors in a fixed relationship to the speeds of first and second chains of the coiled tubing injector, respectively;

transferring force between the first and second timing motors via hydraulic fluid in a closed circuit hydraulically connecting the first and second timing motors in series;

applying a first pressure level to at least one hydraulic cylinder coupled to one of a plurality of skates of the coiled tubing injector;

actuating a valve by a pressure differential within the closed circuit to selectively apply a second pressure level larger than the first pressure level to the at least one hydraulic cylinder;

apply an adjustable pressing force to the one of a plurality of skates coupled to the at least one hydraulic cylinder; and pressing within a gripping zone, the first and second chains toward a coiled tubing with the plurality of skates.

18. The method of using the coiled tubing injector of claim 17, further comprising:

causing the valve to connect a supply of hydraulic fluid at the second pressure level to the at least one hydraulic cylinder upon a magnitude of the pressure differential being in excess of a predetermined level.

19. The method of using the coiled tubing injector of claim 17, wherein the valve is piloted in parallel with at least one of the first or the second timing motor.

20. The method of using the coiled tubing injector of claim 17, further comprising:

bleeding hydraulic fluid through a manifold coupled across at least one of the first and second timing motors.

21. The method of using the coiled tubing injector of claim 17, further comprising:

rotating at least one of the first and second chains with a drive motor coupled to a main hydraulic supply;

coupling the main hydraulic supply to a pressure reducing valve; and selectively coupling the pressure reducing valve to the at least one hydraulic cylinder to apply the second pressure level to the at least one hydraulic cylinder.

22. The method of using the coiled tubing injector of claim 17, further comprising:

driving rotation of the first chain independently from rotation of the second chain by supplying hydraulic fluid in parallel to first and second drive motors coupled to the first and second chains, respectively.

* * * * *